US010612895B2

(12) United States Patent
Stear

(10) Patent No.: US 10,612,895 B2
(45) Date of Patent: Apr. 7, 2020

(54) TAPERED SHOOTING RANGE

(71) Applicant: Bryan A Stear, Ann Arbor, MI (US)

(72) Inventor: Bryan A Stear, Ann Arbor, MI (US)

( * ) Notice: Subject to any disclaimer, the term of this patent is extended or adjusted under 35 U.S.C. 154(b) by 752 days.

(21) Appl. No.: 14/480,057

(22) Filed: Sep. 8, 2014

(65) Prior Publication Data

US 2015/0184985 A1 Jul. 2, 2015

Related U.S. Application Data

(60) Provisional application No. 61/923,199, filed on Jan. 2, 2014.

(51) Int. Cl.
*F41J 11/00* (2009.01)

(52) U.S. Cl.
CPC ..... *F41J 11/00* (2013.01)

(58) Field of Classification Search
CPC ..... F41J 11/00; F41J 13/00; F41J 1/12; F41J 1/18; F41J 7/04; A63B 69/36; A63B 69/38; A63B 47/02
USPC ..... 273/357, 390–410; 473/431–453, 339, 473/194, 167, 94
See application file for complete search history.

(56) References Cited

U.S. PATENT DOCUMENTS 2,835,495 A 5/1958 Lohr
3,306,616 A * 2/1967 Baldwin ..... F41J 3/0004 273/356
3,398,959 A 8/1968 Sanzare
3,870,306 A 3/1975 Iino
4,164,901 A 8/1979 Everett
4,359,842 A 11/1982 Hooker
4,509,301 A 4/1985 Head
4,598,631 A 7/1986 Everett
4,683,688 A 8/1987 Wojcinski
4,703,931 A * 11/1987 Steen ..... A63B 69/0097 273/410
4,948,141 A * 8/1990 Newman ..... A63B 69/3694 472/94
5,088,741 A * 2/1992 Simonetti ..... F41J 11/00 273/406
5,259,291 A 11/1993 Wilson
5,400,692 A 3/1995 Bateman
5,456,155 A 10/1995 Myrtoglou
5,535,662 A 7/1996 Bateman
5,607,163 A 3/1997 Nesler
(Continued)

FOREIGN PATENT DOCUMENTS

RU 2119144 C1 * 9/1998 ..... F41J 1/18

OTHER PUBLICATIONS

Mikhajlenko et al., Underwater Shooting Gallery, Sep. 20, 1998, Russian Federation Patent Office, RU2119144 C1, Espacenet machine translation.*

*Primary Examiner* — Jeffrey S Vanderveen
(74) *Attorney, Agent, or Firm* — Buchanan Ingersoll & Rooney PC

(57) ABSTRACT

A design for a shooting range with tapered shooting lanes or zones is disclosed. The shooting lanes are wider at the position of the shooter than they are at the end of the range, thereby resulting in a design that is cheaper to build and easier to maintain. The tapering of the lanes can be in the horizontal or vertical directions (or both). This design can be used in indoor or outdoor ranges, with firearms, bows, crossbows, air rifles, air softs, and other types of projectiles that are fired, shot, or launched.

15 Claims, 11 Drawing Sheets

(56) References Cited

U.S. PATENT DOCUMENTS

| | | | | |
|---|---|---|---|---|
| 7,185,892 | B2 | 3/2007 | Moberg | |
| 7,194,944 | B2 | 3/2007 | Lambert | |
| 7,357,394 | B2 | 4/2008 | Halverson | |
| 7,434,811 | B1 | 10/2008 | Coburn | |
| 7,766,338 | B1 | 8/2010 | Adler | |
| 7,909,331 | B2 * | 3/2011 | Halverson | F41J 13/00 273/404 |
| 7,967,296 | B1 | 6/2011 | Halverson | |
| 8,479,464 | B2 | 7/2013 | Holzworth | |
| 8,597,026 | B2 | 12/2013 | Cincotti | |
| 8,602,418 | B1 | 12/2013 | Hering | |
| 8,651,493 | B1 | 2/2014 | Adler | |
| 2008/0258395 | A1 * | 10/2008 | Halverson | F41J 11/00 273/410 |
| 2014/0042701 | A1 | 2/2014 | Trichilo | |
| 2014/0106310 | A1 | 4/2014 | Cincotti | |

* cited by examiner

TAPERED SHOOTING RANGE

RELATED APPLICATION

This application claims the benefit of co-pending U.S. Provisional Patent Application 61/923,199, filed on Jan. 2, 2014, the contents of which are hereby incorporated by reference.

FIELD OF THE INVENTION

The present invention generally relates to the design and construction of a shooting range. More specifically, it relates to a tapered design of a gun range.

BACKGROUND OF THE INVENTION

Indoor facilities for discharging firearms (often called, for example, shooting, gun, or firing ranges) have been around for years. They allow shooters to practice and train with their firearms in the safety and convenience of an indoor facility, without having to be concerned about inclement weather or the risk that a stray bullet will leave the range or inadvertently harm or injure another. Shooters can aim at various kinds of targets in order to practice and improve their efficiency and skills in various situations.

A typical shooting range is rectangular in shape, with a series of parallel shooting lanes that extend from the front end of the range (where the shooter is located) to the targets (which can be placed at varying distances from the shooter) to the back end of the range (which has some form of backstop or trap to capture or contain the fired projectiles). For instance, pistol ranges can be as short as 15 feet, while rifle ranges can be as long as 300 feet. Other distances in between, as well as shorter or longer, are also possible. The lanes are frequently at least four feet wide to accommodate the shooter and an instructor, although other widths (narrower or wider) can be used. The height of the range is often dictated by existing building conditions (such as ten-foot-high ceilings), but it can be of varying heights as desired.

With the inherent risks of these projectiles, care should be taken to make sure that the range is safe for both the shooter and others who may be nearby. The walls and ceilings are often made of ballistically-resistant materials, such as reinforced concrete, masonry block, steel plates, or a combination of these materials, although other materials are also possible. The down-range end of the range contains a backstop that contains or stops the projectile in a safe manner and is designed to withstand the full force of the fired projectile. The backstop is often made from ballistically-resistant materials, such as curved or angled steel plates, ballistic rubber media, dirt, sand, ballistic curtains, or combinations of these materials.

Given the materials required to construct a shooting range, which should be made of ballistically-resistant materials that can withstand and contain repeated exposure to bullets or other projectiles that are travelling at high velocities and with large momentum, these ranges are expensive to construct. In particular, the down-range end of the range is often the most expensive part of the range to build. In addition to construction costs, there are maintenance and repair costs that depend, at least in part, on the size of the down-range end of the shooting range.

Thus, a design that still allows the shooter the convenience and safety of a standard shooting range at a reduced construction cost is highly desirable for an owner or operator of the range.

SUMMARY OF THE INVENTION

The present invention is a new design for a shooting/firing range that revolutionizes the industry standards and can save an owner significant amounts in building costs as compared to the costs for a conventional shooting range. It takes the traditional square or rectangular shape of a shooting range and replaces it with a tapered or trapezoidal design that can significantly reduce the size of the bullet trap/backstop at the down-range end of the range. The shooters' shooting lanes remain roughly the same size, but the backstop or bullet trap is reduced in size, which in turn reduces the costs, materials, and time to build. It also has the advantage of drawing the shooters' eyes downrange for increased performance. While primarily intended for indoor ranges, the same principles can be used with outdoor ranges.

This invention can be used with firearms (such as pistols, shotguns, rifles, and semi-automatic and automatic firearms), bows, crossbows, air rifles, airsoft, and other types of projectiles that are fired, shot, or launched.

In one embodiment, a shooting range comprising: a front end; a back end; a first shooting lane extending from the front end to the back end, wherein the width of the first shooting lane at the front end is greater than the width of the first shooting lane at the back end; and a ballistically-resistant backstop located at the back end.

In another embodiment, a shooting range comprising: a front end; a back end; a first shooting lane extending from the front end to the back end, wherein the width of the first shooting lane is greater at the front end than the width of the first shooting lane at the back end; a second shooting lane extending from the front end to the back end and adjacent to the first shooting lane, wherein the width of the second shooting lane at the front end is greater than the width of the second shooting lane at the back end; a ballistically-resistant backstop located at the back end; a ballistically-resistant dividing barrier located at the front end and between the first shooting lane and the second shooting lane.

In still another embodiment, a shooting range, comprising: a front end; a back end; a plurality of shooting lanes adjacent to one another and extending from the front end to the back end, wherein the width at the front end of each shooting lane is greater than the width at the back end of each shooting lane; ballistically-resistant dividing barriers located at the front end and between each shooting lane; a ballistically-resistant backstop located at the back end; a ceiling above the front end, the back end, and the plurality of shooting lanes; and a floor below the front end, the back end, and the plurality of shooting lanes.

In yet another embodiment, a shooting range, comprising: a front end; a back end; a shooting zone extending from the front end to the back end; a ballistically-resistant backstop located at the back end; a plurality of shooting positions at the front end; ballistically-resistant dividing barriers between each shooting position; a ceiling above the front end, the back end, and the shooting zone; and a floor below the front end, the back end, and the shooting zone; wherein the ratio of the width of the front end to the width of the back end is from 1.25 to 4.

In another embodiment, an indoor shooting range, comprising a front end; a back end; a plurality of trapezoidal shooting lanes adjacent to one another and extending from the front end to the back end, wherein the ratio of the width of each shooting lane at the front end to the width of each shooting lane at the back end is between 1.25 and 4; ballistically-resistant dividing barriers located at the front end and between each shooting lane; a ballistically-resistant backstop located at the back end; a ballistically-resistant ceiling above the front end, the back end, and the plurality of shooting lanes; and a ballistically-resistant floor below the front end, the back end, and the plurality of shooting lanes.

These are just some exemplary embodiments of the invention. One of ordinary skill in the art would recognize that other embodiments, including those with some, all, different, or additional components would fall within the scope of the invention.

DETAILED DESCRIPTION OF THE INVENTION

An exemplary embodiment of the invention is described below. Those skilled in the art will recognize that variants of this exemplary embodiment can be used to practice the invention claimed.

Figure 1:
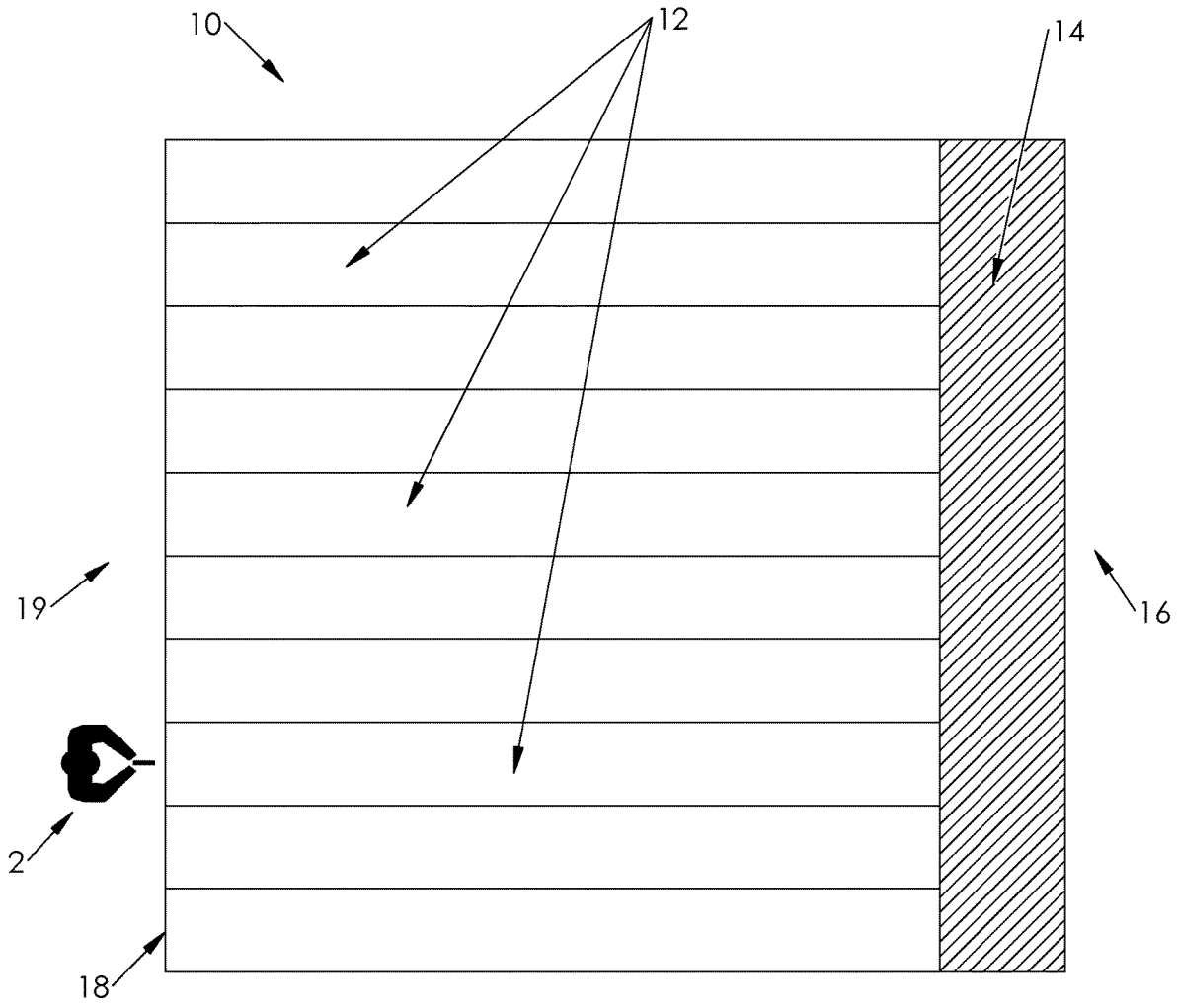
FIG. 1 is an overhead view of a conventional shooting range layout.

FIG. 1 shows a conventional, rectangular version of shooting range 10. Range 10 has ten adjacent shooting lanes 12 that are four feet wide, eight feet high, and 25 yards long. With these dimensions, range 10 has an overall rectangular shape as viewed from above and a total size of 40 feet wide, 75 feet long, and eight feet tall. Range 10 has backstop 14 down range at back end 16 that is comprised of standard bullet-stopping or ballistically-resistant materials, such as was described above. Firing line 18 is at the opposite end (or front end 19) of the range from back end 16 and is where shooter 2 stands to fire his or her firearm. The above dimensions do not include additional space needed for shooter 2 to stand, for ingress/egress, or for watching shooter 2 that would be behind shooter 2. In this configuration, the total cross-sectional area of backstop 14/back end 16 is 320 square feet (40 feet wide by 8 feet high).

Figure 2:
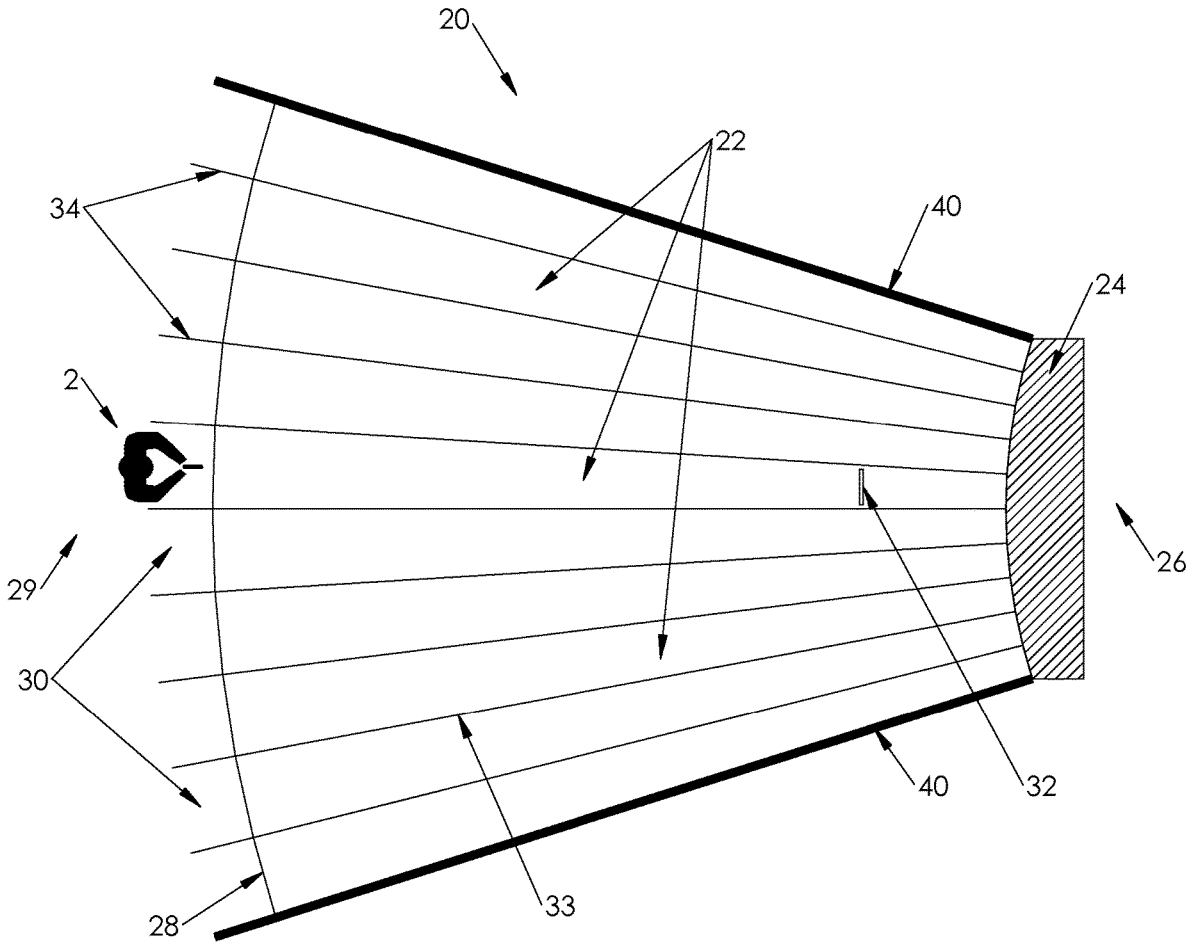
FIG. 2 is an overhead view of an embodiment of the invention with a curved firing line.

FIG. 2 shows an embodiment of the invention for a ten-lane range 20 that improves on the design shown in FIG. 1. In the embodiment shown in FIG. 2, the size of backstop 24 near back end 26 can be reduced dramatically over the conventional range shown in FIG. 1 by creating adjacent shooting lanes 22 with a trapezoidal or tapered shape (when viewed from above). In this embodiment, shooting positions 30 of lanes 22 in front end 29 of range 20 (where shooter 2 stands) remain four feet wide, but lanes 22 taper down to only two feet in width at back end 26 of range 20. This configuration creates a ratio of 2:1 between the width of lanes 22 at shooting position 30 and the width of lanes 22 at back end 26. By configuring range 20 in this fashion, the cross-sectional area of back end 26 would only be 160 square feet in size (20 feet wide by 8 feet high), instead of the 320 square feet in the conventional setup described above. This design allows for a significantly smaller backstop 24 and back end 26 and significantly reduced construction and maintenance costs. In addition, given the length of range 20, this tapering is not readily apparent to shooter 2, so it creates the illusion that shooter 2 is firing on a conventional parallel range even though he or she is not.

Lanes 22 are defined regions within range 20 that extend from front end 29 to back end 26 in which a projectile fired by shooter 2 is supposed to travel (or at least until it hits its target or the mechanism that is supposed to stop or contain the projectile). Shooter 2 stands in shooting position 30 at firing line 28 in front end 29 of range 20 and aims at target 32 in his or her lane in the direction of backstop 24/back end 26. Shooting position 30 can take a variety of shapes and forms, such as being an open space, a booth, or a stall, among other things, and can include various materials to assist shooter 2, such as sandbags for stabilizing a rifle or a shelf or table for holding weapons and ammunition. In a conventional shooting range (as shown in FIG. 1), lanes 12 are rectangular in shape when viewed from above. In the embodiment of the invention shown in FIG. 2, lanes 22 are trapezoidal in shape when viewed from above. In the particular embodiment shown in FIG. 2, the ratio of the width of lanes 22 at front end 29 to the width of lanes 22 at back end 26 is 2:1. Other ratios, such as between 5:4 and 4:1 or more could be used and fall within the scope of the invention. Lanes 22 may be marked (such as with lines, lights, etc.) or unmarked or may be segregated from one another or left open.

Figure 3:
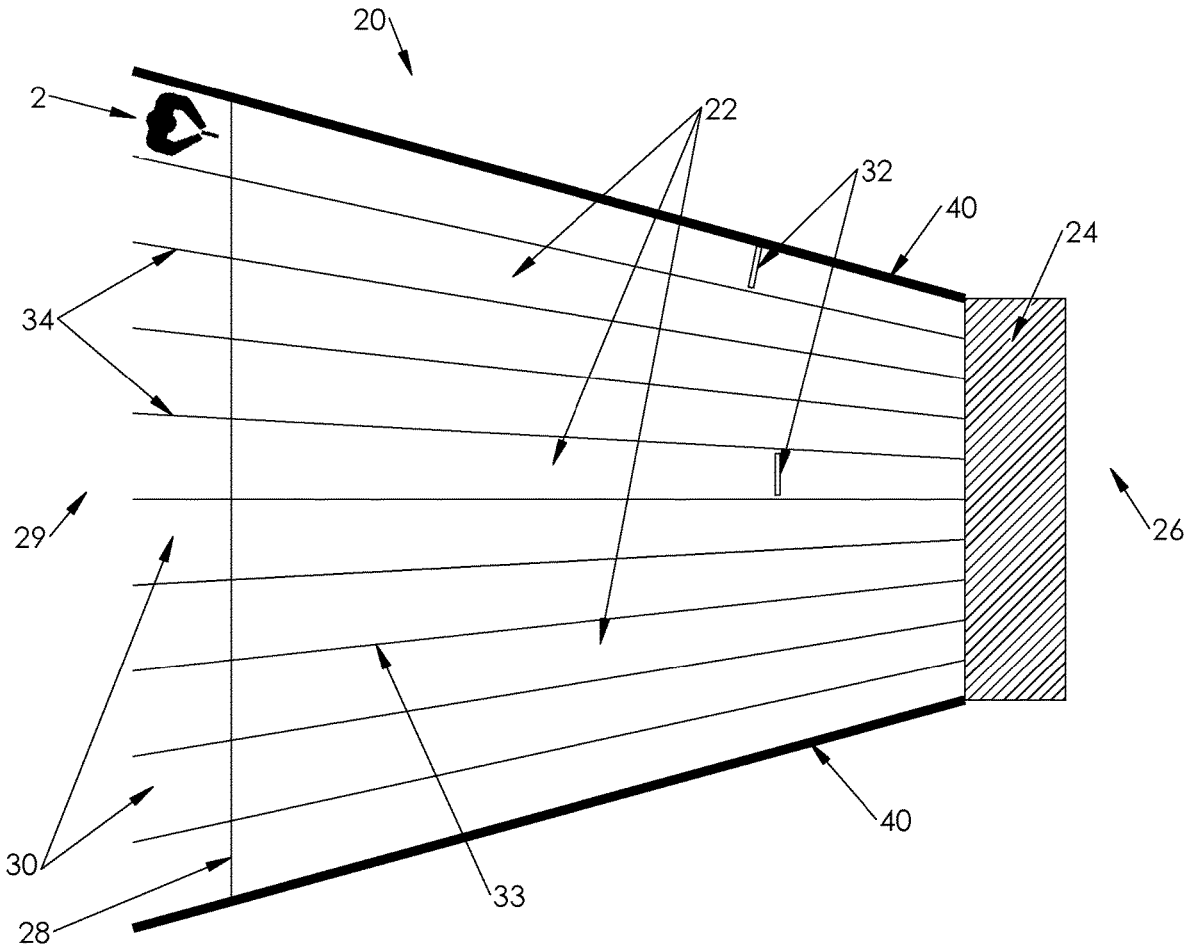
FIG. 3 is an overhead view of an alternative embodiment of the invention where the firing line and the end of the range are parallel to one another.
Figure 4:
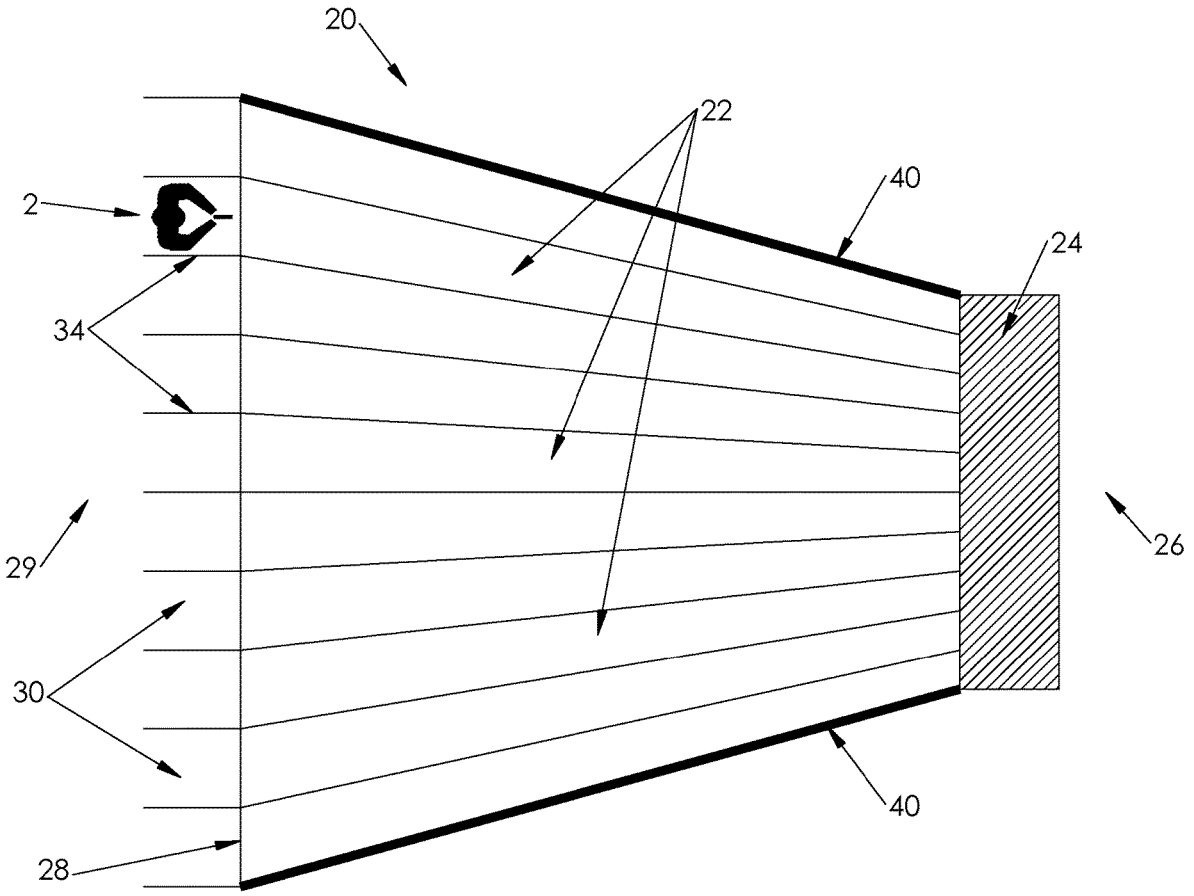
FIG. 4 is an overhead view of an alternative embodiment with parallel dividing walls.

Each shooting position 30 is separated from the others by short dividing barriers or walls 34 that are perpendicular to firing line 28. Shooting positions 30 are usually wide enough to enable two people to stand side-by-side (e.g., 36 to 48 inches). But, shooting positions 30 can be as narrow as comfortable for one shooter or wider to accommodate additional room for a shooter or instructor. Dividing barriers 34 normally extend sufficiently into lanes 22 and shooting positions 30 such that they will prevent any accidental discharge from one shooter from going into another shooting position, but generally do not extend down the entire length of lanes 22. Dividing barriers 34 can be made of any ballistically-resistant material that is strong enough to withstand a projectile without allowing it to penetrate far enough to pose a risk to adjacent shooters, instructors, or bystanders. Typically, steel is used, but dividing barriers 34 can also be made of bullet-resistant glass, plastic, composite materials like carbon fiber, masonry blocks, poured concrete, or a combination of these ballistically-resistant materials, among other things. Dividing barriers 34 commonly run flush to the floor and can extend all the way to the ceiling, although they do not have to extend this far. Dividing barriers 34 can be angled slightly with respect to one another (as shown in FIGS. 2 and 3) so that they are parallel to a line 33 formed by the border between adjacent shooting lanes (and, therefore, roughly parallel to the direction of fire), but this is not critical. Such an angled configuration can help shooter 2 feel as if he or she is standing square to the firing line. Alternatively, dividing barriers 34 can be parallel to one another, as shown in FIG. 4. The exact orientation of dividing barriers 34 can vary from these examples and still fall within the scope of the invention.

By stacking these trapezoidal-shaped lanes 22 next to each other, range 20, front end 29, and back end 26 can take on an overall curved or arced appearance when viewed from above, as shown in FIG. 2. Alternatively, the curvature of range 20 could be eliminated by constructing the range with front end 29 and back end 26 being parallel. In this alternative embodiment, shown in FIG. 3, the lengths of lanes 22 would vary, with the inner lanes being shorter than the outer lanes. In order to keep standardized target distances, targets 32 could be staggered from one another, with the targets in the inner lanes being closer to back end 26 than those targets in the outer lanes.

Figure 5:
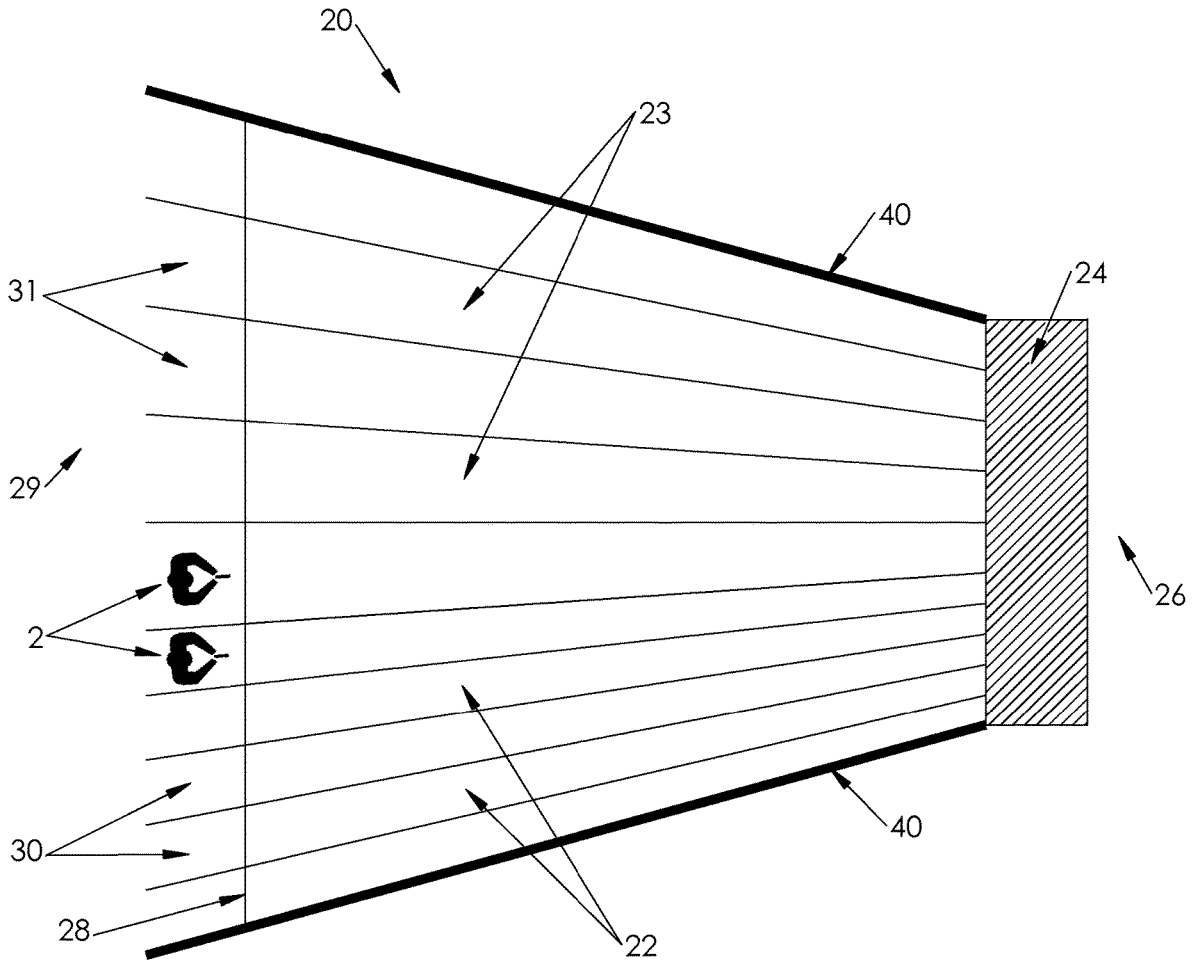
FIG. 5 is an overhead view of an alternative embodiment with different lane widths.

While one would generally construct a range to have identical width lanes, the invention can be used in ranges that have lanes of different widths, as is shown in FIG. 5. Lanes 23 could be wider at the shooting positions than they are in lanes 22 in order to facilitate easier instruction or to accommodate shooters that require additional space (such as those that might be in a wheelchair) or targets that require additional space. In these circumstances, the operator can design range 20 such that the width at shooting positions 31 is greater than the width at shooting positions 30. For example, the width of lanes 22 at shooting positions 30 could be three feet, while the width of lanes 23 at shooting positions 31 could be five feet. In this example, the width of lanes 22 and 23 at back end 26 could vary proportionately. The operator can either make the width of lanes 23 at back end 26 different from the width of lanes 22 at back end 26 or the same. Different widths and ratios (either greater or less) of the width between the shooting positions and the back ends could be used and fall within the scope of this invention.

Figure 6:
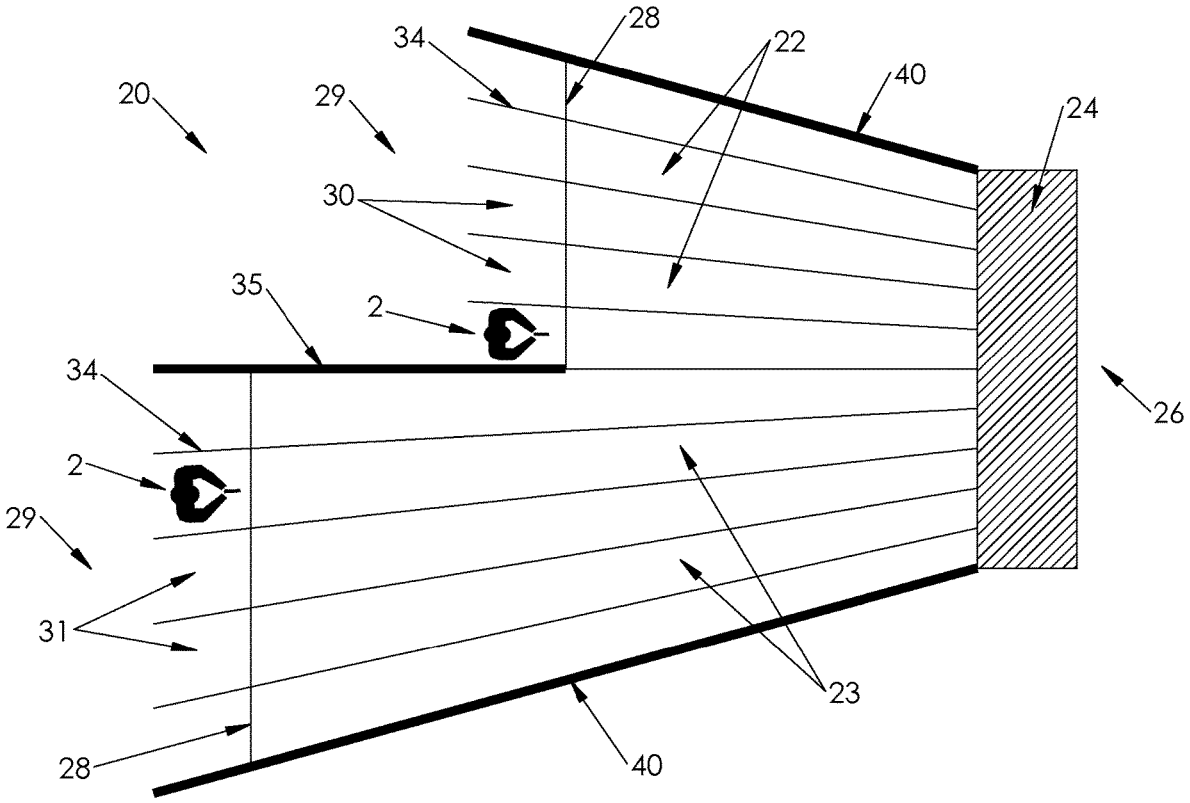
FIG. 6 is an overhead view of an alternative embodiment with different length lanes.

In yet another embodiment, shown in FIG. 6, range 20 can have lanes of different lengths. Thus, an operator could have shorter lanes designed for shorter-range firearms (such as pistols) next to lanes designed for longer-range firearms (such as rifles) in the same range. In the embodiment shown in FIG. 6, lanes 22 are 75 feet long, with a width of three feet at shooting positions 30 and a width of two feet at back end 26. Lanes 23 are 150 feet long, with a width of five feet at shooting positions 31 and a width of two feet at back end 26. A long, bulletproof dividing wall 35 protects shooters in lanes 22 from any stray rounds coming from lanes 23. Different lengths of lanes 22 and 23 (both longer and shorter), as well as the widths of these lanes at shooting positions 30 and 31 and back end 26 (both wider and narrower), can be used and fall within the scope of this invention. Additionally, this principle can be expanded to include more than just two lengths of lanes that are together. Thus, an operator can use this concept to have two, three, four, or more lanes of different lengths that are together in one common range. For example, an operator could have four 75-foot lanes, three 150-foot lanes, and three 300-foot lanes together in one range. Different lengths, combinations of lengths, and the number of different lengths in a range (both greater and less) could be used and fall within the scope of this invention.

Figure 12:
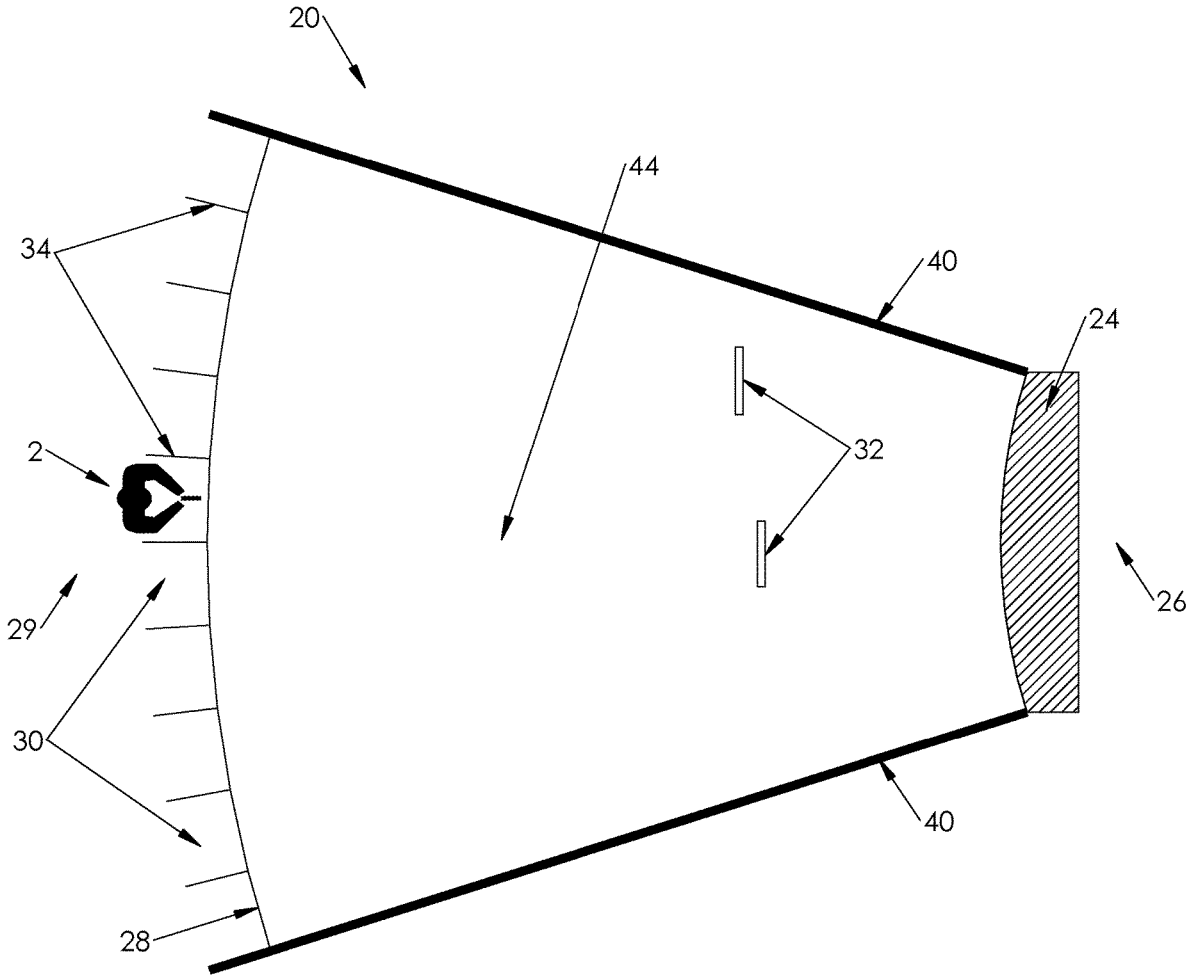
FIG. 12 is a top view of an alternative embodiment with a shooting zone instead of shooting lanes.

In still another embodiment, shown in FIG. 12, range 20 can have multiple shooting positions 30, but no designated lanes. Range 20 is constructed with an overall tapered or trapezoidal shape when viewed from above, thereby reducing the cross-sectional area of range 20 at back end 26 in comparison to the cross-sectional area at front end 29, as discussed above. In this configuration, shooter 2 would fire through an open shooting zone 44, instead of in lanes 22 to hit targets 32. Such a configuration would be useful for ranges in which the targets are scattered throughout back end of the range, as might happen with certain tactical simulations, instead of being fixed targets designated for a single shooter in a single lane.

Figure 13:
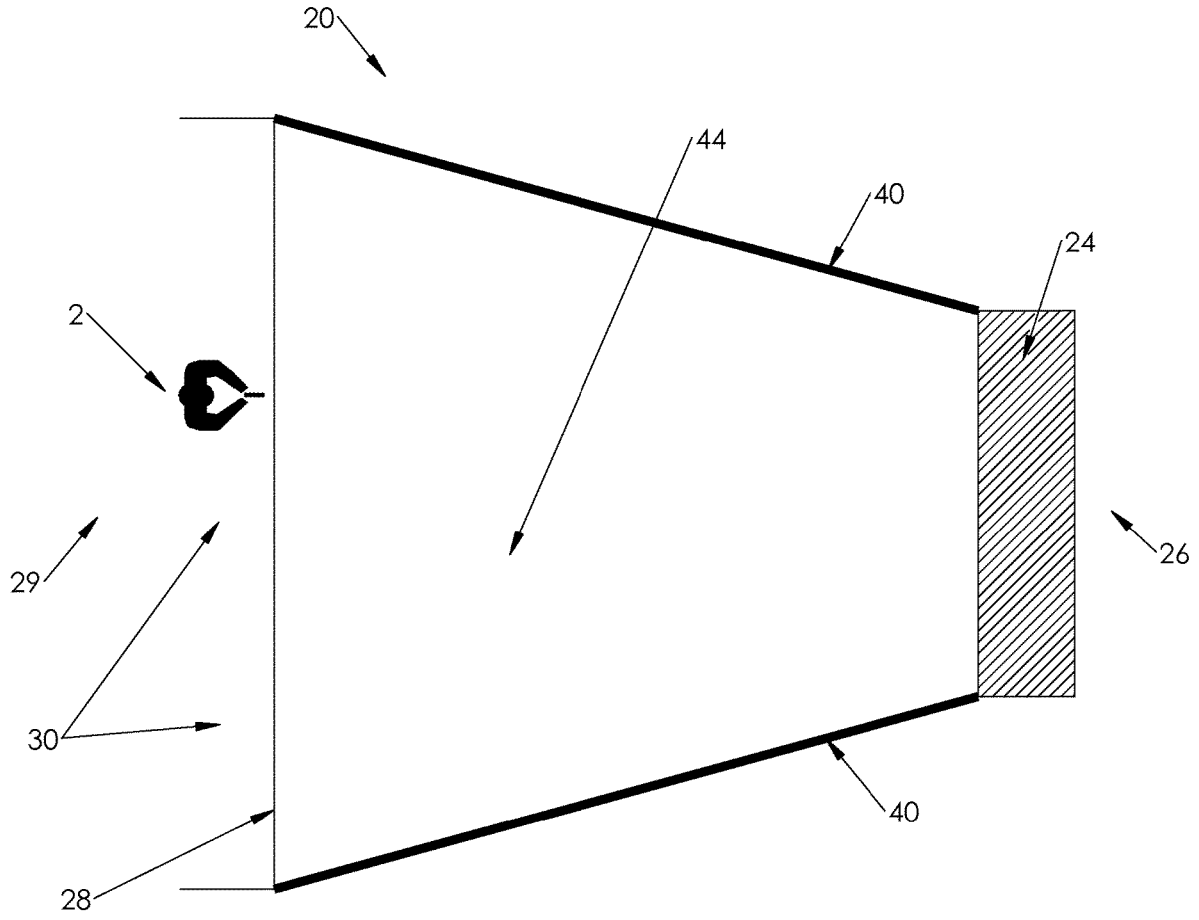
FIG. 13 is a top view of an alternative embodiment with a shooting zone and no dividing barriers.

In yet another embodiment, shown in FIG. 13, range 20 does not have dividing barriers between shooting positions 30. As discussed above, range 20 still has an overall tapered or trapezoidal shape when viewed from above, thereby reducing the cross-sectional area of range 20 at back end 26 in comparison to the cross-sectional area at front end 29. In this embodiment, there can be lanes 22 that are designated for each shooter, or there can be an open shooting zone 44, as was discussed above in relation to the embodiment shown in FIG. 12. This non-dividing barrier configuration might be used in rifle ranges, where the risks of inadvertent fire between shooting positions 30 are low or in circumstances where an individual or a group wants to simulate certain tactical scenarios that require the shooter to move across range 20 or function with a team of shooters across range 20.

As shown in FIGS. 7-10, floor 36 is located below range 20 (and lanes 22, front end 29, and back end 26) and shooter 2. Floor 36 should be made from ballistically-resistant materials that are strong enough to withstand errant shots and not cause safety concerns for shooters or bystanders. Floor 36, therefore, is typically made of poured concrete, but other materials, such as dirt, sand, metal, or a combination of these materials, among other things, could be used and fall within the scope of the invention.

Ceiling 38 is located above range 20 (and lanes 22, front end 29, and back end 26) and shooter 2. Ceiling 38 should also be made from ballistically-resistant materials that are strong enough to withstand errant shots and not cause safety concerns for shooters or bystanders. Ceiling 38 can be reinforced with steel panels (commonly referred to as baffles) to help direct errant shots safely into backstop 24. The steel panels do not need to be reinforced themselves, but are commonly covered with plywood and acoustic paneling to help reduce sound and ricochets. Other materials, such as reinforced concrete and masonry block, or a combination of these materials, among other things, can also be used in ceiling 38.

Figure 7:
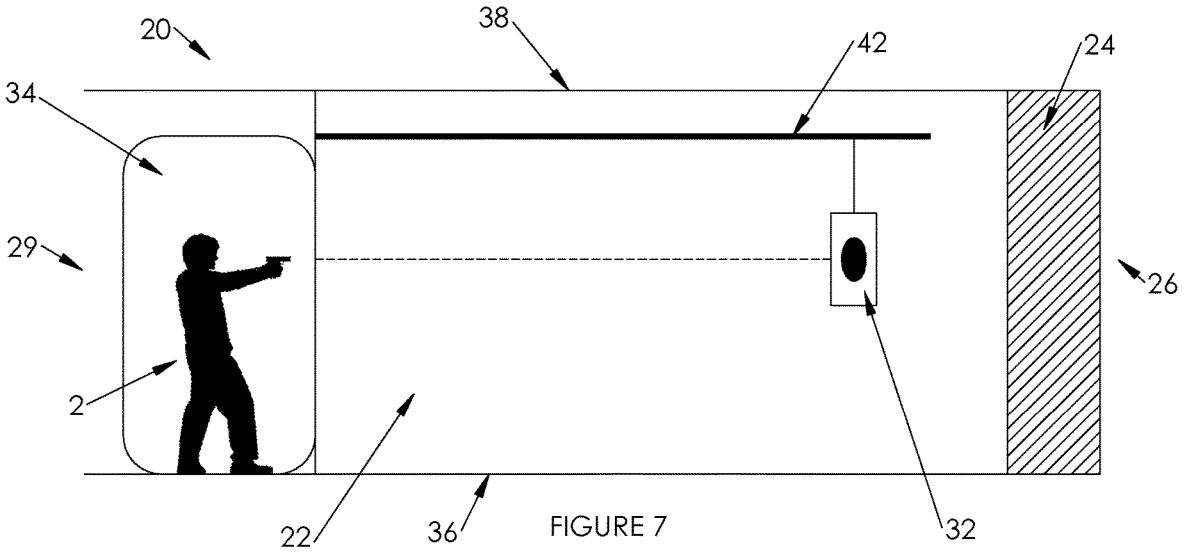
FIG. 7 is a side view of an embodiment of the invention with a parallel floor and ceiling and targets hanging from a target retriever.
Figure 8:
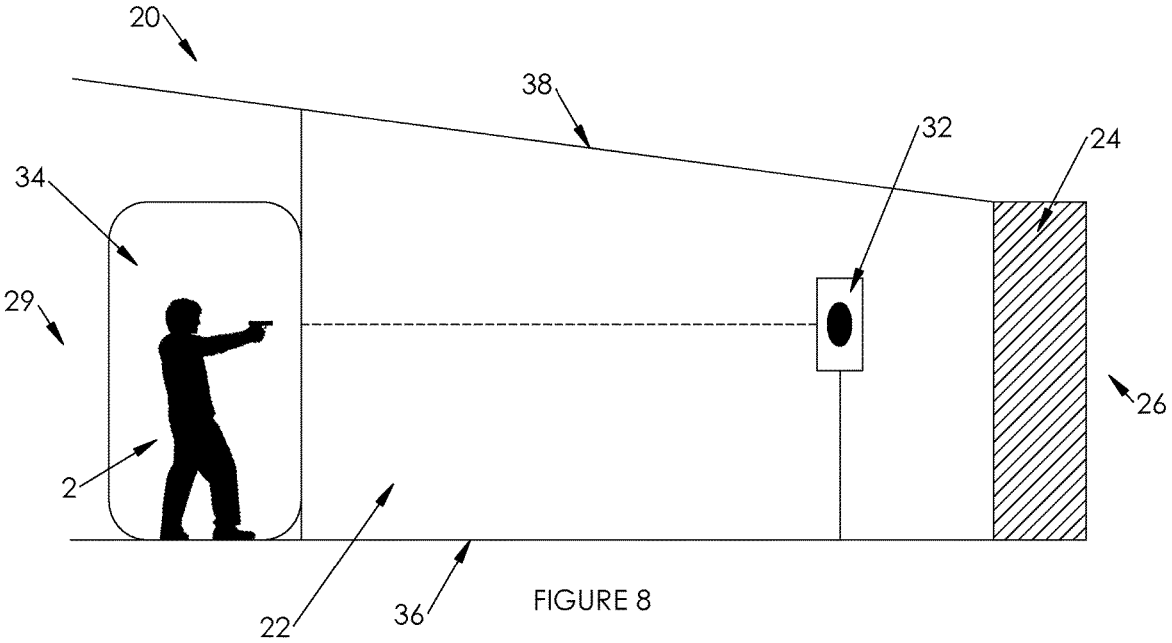
FIG. 8 is a side view of an alternative embodiment of the invention with a level floor and a sloped ceiling.
Figure 9:
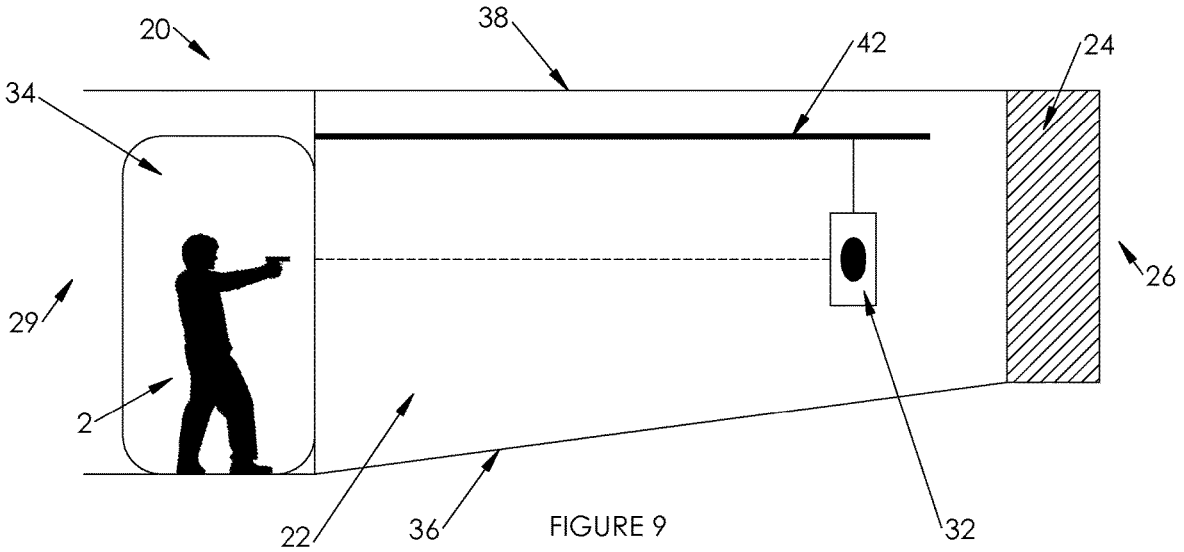
FIG. 9 is a side view of an alternative embodiment of the invention with a level ceiling and a sloped floor.
Figure 10:
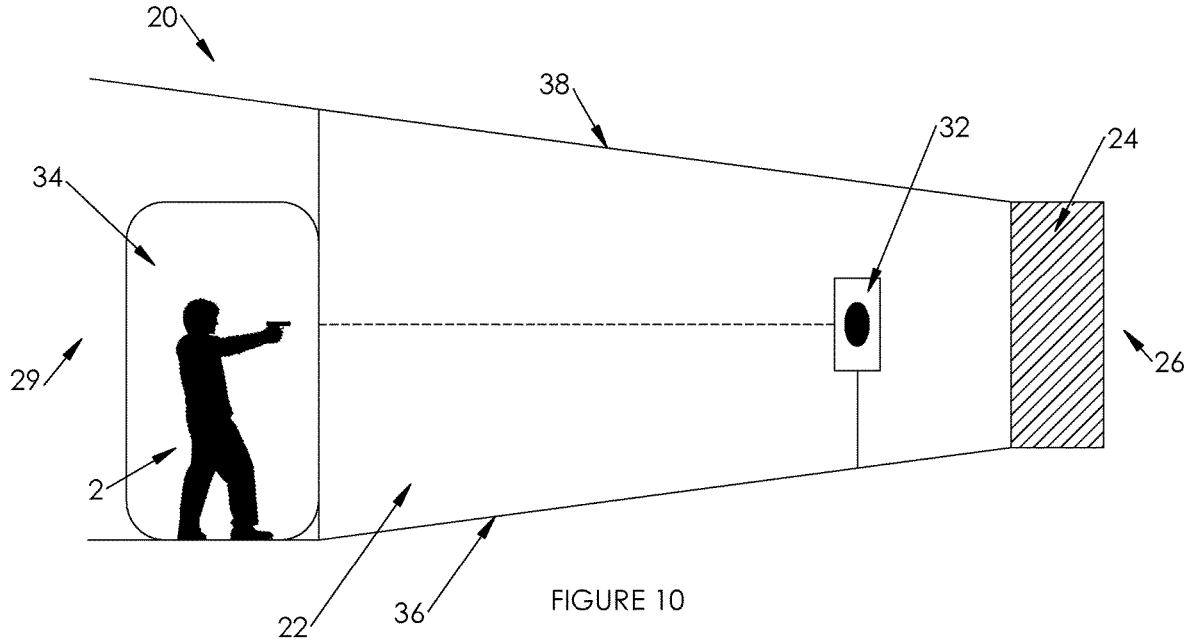
FIG. 10 is a side view of an alternative embodiment of the invention with a sloped floor and a sloped ceiling.
Figure 11:
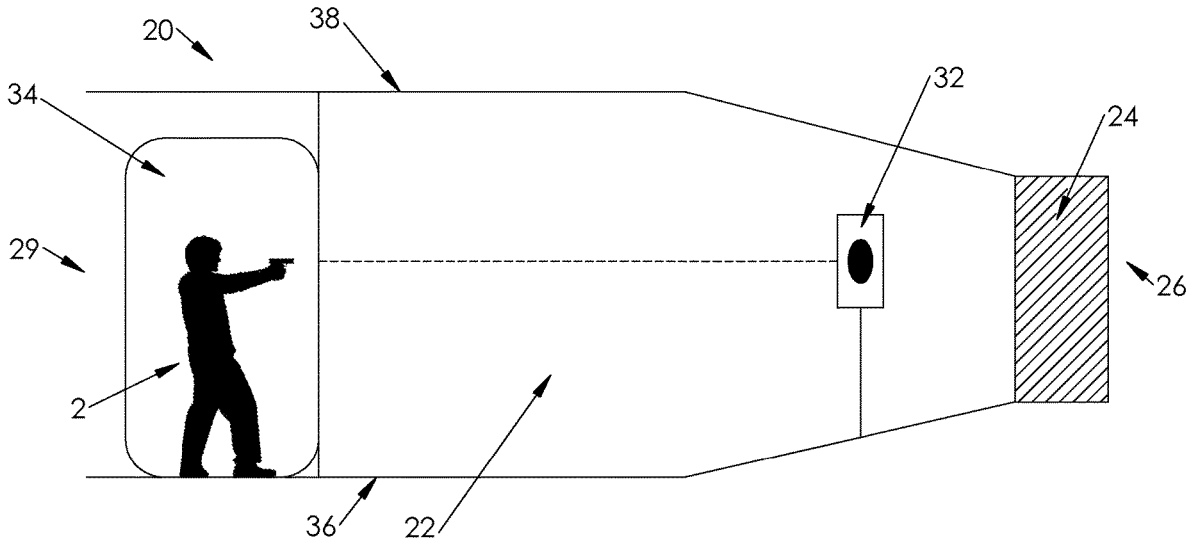
FIG. 11 is a side view of an alternative embodiment of the invention with a floor and ceiling of various slopes.

In an indoor range, the height of range 20 (i.e., from floor to ceiling) can vary and is often dictated by the constraints of the building in which range 20 is located, but it is typically around eight feet. In one embodiment, the height of range 20 remains constant and level (i.e., with little or no appreciable sloping upwards or downwards) from front end 29 to back end 26, as shown in FIG. 7, with floor 36 being parallel to ceiling 38. In another embodiment, the height of range 20 can vary along lanes 22. In particular, the same horizontal tapering described above can also occur vertically. For example, in one embodiment shown in FIG. 8, floor 36 can remain flat and level, while ceiling 38 is flat and slopes downward from a height of ten feet at front end 29 to eight feet at back end 26. Such a design would be particularly beneficial for ranges that have high ceilings, because this design would further reduce the cross-sectional areas of backstop 24 and back end 26. Alternatively, floor 36 could slope upwards from zero feet to three feet while ceiling 38 remains flat and level (as shown in FIG. 9). In yet another embodiment, as shown in FIG. 10, both floor 36 and ceiling 38 can slope upwards and downwards, respectively, to create a four-foot high area at back end 26, which thereby reduces even further the cross-sectional areas of backstop 24 and back end 26. In still another embodiment, one example of which is shown in FIG. 11, the vertical tapering can be discontinuous and start (or increase) down range instead of beginning at front end 29. The down-range tapering can be in either the floor or ceiling or both and can start at different positions from one another. While these embodiments describe floors and ceilings that are flat, the same concepts can apply to floors and ceilings that are curved, discontinuous, or that have protrusions, projections, holes, or other non-uniformities in them, and the invention is meant to encompass all of these designs and configurations. Thus, the sloping of floor 36 or ceiling 38 (or both) may be constant, as shown in FIGS. 8-10, or it may vary across floor 36 and ceiling 38 (one example of which is shown in FIG. 11). In an alternative example, the sloping may change from front end 29 to back end 26 in a smooth or in a discontinuous fashion.

Walls 40 surround lanes 22 and help to contain the projectiles within range 20. Like with floor 36 and ceiling 38, walls should be made from ballistically-resistant materials that are strong enough to withstand errant shots and not cause safety concerns for shooters or bystanders. Walls 40, therefore, are typically made of poured concrete, but other materials, such as masonry blocks, steel, dirt, sand, or a combination of these materials, among other things, could be used and fall within the scope of the invention.

Backstop 24 can be made of a number of ballistically-resistant materials, such curved or angled steel plates, ballistic rubber media, dirt, sand, ballistic curtains, or combinations of these materials. For example, ⅜"-thick AR500 steel plates can be used. Backstop 24 is meant to safely stop and contain the projectiles fired by shooter 2. Backstops that allow an operator to harvest the spent rounds are commonly referred to as bullet traps and can feature a small opening near the back where the rounds are collected. This opening usually extends across the full width of trap 24. A variety of different types of backstops or traps can be used with the invention and fall within the scope of the invention disclosed.

Typically, shooter 2 at range 20 aims at target 32 placed down range and near to back end 26 or backstop 24 (although the exact distance can vary). These targets 32 can take a variety of forms, such as cardboard targets, paper targets, metal targets, drop-down targets, silhouettes, and mannequins, among other things. As shown in FIGS. 7 and 9, targets 32 can be attached to target retrievers 42, which are mechanical devices that are either manually or electronically controlled, to move targets 32 up or down range 20 to a desired location or distance. Often target retrievers 42 are suspended or attached to ceiling 38 and have tracks along the center of lanes 22 on which targets 32 move. Such a design is often used with paper or cardboard targets. Alternatively, as shown in FIGS. 8 and 10, targets 32 can be permanently or semi-permanently fixed at a desired location down range from firing line 28, such as with drop-down targets that can be remotely raised or lowered. A variety of different targets (or no target at all) can be used with the invention and fall within the scope of the invention disclosed.

This design can be utilized with the traditional accessories found in conventional ranges, such as tables for placing firearms and ammunition, controls for target retrievers or lights, scoring displays, or ventilation systems, for example. Because the design relates to the configuration of the range between front end 29 and back end 26, the traditional aspects of a range behind the shooters (i.e., in the direction opposite back end 26), such as viewing galleries, lockers, instructional materials, warning signs, etc., can be utilized with this design, as well.

While a ten-lane, 25-yard long, eight-foot high range is described, one of ordinary skill in the art would understand that the invention can be used with ranges that have more or less lanes (e.g., from one to many dozens), that are longer or shorter (e.g., 15 to 300 feet or more), that have higher or lower ceilings (e.g., 6 to 15 feet or more), that have lane widths that are wider or narrower (e.g., 3 to 6 feet or more at the firing line to 1 to 5 feet or more at the end/backstop) or in different ratios (e.g., 8:7 to 4:1, or greater or less than these ratios), or that have different lengths of lanes and still fall within the scope of the invention.

While the embodiments described above are primarily intended to be used with firearms (such as handguns, shotguns, rifles, semi-automatic and automatic firearms), the invention can also be used with other types of projectiles that are fired, shot, or launched in enclosed spaces, such as bows, crossbows, air rifles, and airsoft, among other things. The type of backstop may differ depending on the projectile being fired, shot, or launched, but the configurations would be similar and the same principles would apply. In addition, the invention can be used in outdoor settings in which the cost of backstop 24 is a concern. The same principles of tapered lanes 22 or shooting zones 44 can apply equally to lanes or zones inside or outside.

The foregoing description has been presented for purposes of illustration and description, and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention.

I claim:

1. A shooting range, comprising:
a firing line at a front end;
a back end;
a floor below the front end and the back end;
a ceiling above the front end, the back end, and the floor;
walls extending from the floor to the ceiling and from the front end to the back end and defining the widths of the front end and the back end;
wherein the back end is between 15 to 300 feet from the front end and the ratio of the width of the front end to the width of the back end is between 1.25 and 4; and
a ballistically-resistant backstop located at the back end and contained within the width of the back end.

2. The shooting range of claim 1, wherein the front end is parallel to the back end.

3. The shooting range of claim 1, wherein the front end is curved.

4. The shooting range of claim 1, wherein the back end is curved.

5. The shooting range of claim 1, further comprising a ballistically-resistant dividing barrier located at the front end.

6. The shooting range of claim 1, wherein the ballistically-resistant backstop is a bullet trap.

7. The shooting range of claim 1, wherein the ceiling is parallel to the floor.

8. The shooting range of claim 1, wherein the ceiling slopes downward from the front end to the back end.

9. The shooting range of claim 1, wherein the floor slopes upward from the front end to the back end.

10. The shooting range of claim 1, wherein the ceiling slopes downward from the front end to the back end and the floor slopes upward from the front end to the back end.

11. The shooting range of claim 1, wherein the distance between the floor and the ceiling at the front end is greater than the distance between the floor and the ceiling at the back end.

12. The shooting range of claim 1, further comprising a plurality of shooting positions at the front end.

13. The shooting range of claim 12, further comprising ballistically-resistant dividing barriers between each shooting position.

14. The shooting range of claim 1, further comprising a target located between the front end and the back end.

15. An indoor shooting range, comprising:

a firing line at a front end;

a back end;

a plurality of shooting positions at the front end;

ballistically-resistant dividing barriers located at the front end and between each shooting position;

a ballistically-resistant ceiling above the front end, the back end, and the plurality of shooting positions;

a ballistically-resistant floor below the front end, the back end, and the plurality of shooting positions;

walls extending from the ballistically-resistant ceiling to the ballistically-resistant floor and from the front end to the back end and defining the widths of the front end and the back end;

wherein the back end is between 15 to 300 feet from the front end and the ratio of the width of the front end to the width of the back end is between 1.25 and 4; and a ballistically-resistant backstop located at the back end and contained within the width of the back end.

* * * * *